US009410382B2

(12) United States Patent
Reddy et al.

(10) Patent No.: US 9,410,382 B2
(45) Date of Patent: Aug. 9, 2016

(54) DRILLING RIG CARRIAGE MOVABLE ALONG RACKS AND INCLUDING PINIONS DRIVEN BY ELECTRIC MOTORS

(71) Applicant: Nabors Drilling International Limited, Hamilton (BM)

(72) Inventors: Padira Reddy, Richmond, TX (US); Ashish Gupta, Houston, TX (US); Sean M. Bailey, Willis, TX (US); Todd Fox, Cypress, TX (US); Scott G. Boone, Houston, TX (US); Beat Kuttel, Spring, TX (US)

(73) Assignee: NABORS DRILLING INTERNATIONAL LIMITED, Hamilton (BM)

( * ) Notice: Subject to any disclaimer, the term of this patent is extended or adjusted under 35 U.S.C. 154(b) by 292 days.

(21) Appl. No.: 13/964,830

(22) Filed: Aug. 12, 2013

(65) Prior Publication Data

US 2013/0327543 A1 Dec. 12, 2013

Related U.S. Application Data

(63) Continuation-in-part of application No. 13/797,265, filed on Mar. 12, 2013, now Pat. No. 9,273,524.

(60) Provisional application No. 61/646,686, filed on May 14, 2012.

(51) Int. Cl.

| | |
|---|---|
| ***E21B 19/083*** | (2006.01) |
| ***E21B 15/00*** | (2006.01) |
| ***E21B 19/14*** | (2006.01) |

(52) U.S. Cl.

CPC ..... *E21B 19/14* (2013.01); *E21B 15/00* (2013.01); *E21B 19/083* (2013.01)

(58) Field of Classification Search

CPC ..... E21B 19/083; E21B 3/02; E21B 15/00

See application file for complete search history.

(56) References Cited

U.S. PATENT DOCUMENTS

| | | | |
|---|---|---|---|
| 2,792,198 | A | 5/1957 | Braun |
| 3,650,339 | A | 3/1972 | Selfe et al. |

(Continued)

FOREIGN PATENT DOCUMENTS

| | | | |
|---|---|---|---|
| DE | 102004004315 | A1 | 8/2005 |
| EP | 0548900 | A2 | 6/1993 |

(Continued)

OTHER PUBLICATIONS

International Search Report and Written Opinion issued in International Patent Application No. PCT/US2013/039695 dated Apr. 2, 2014 (9 pages).

*Primary Examiner* — Giovanna C Wright

(74) *Attorney, Agent, or Firm* — Adolph Locklar

(57) ABSTRACT

According to one aspect, a drilling rig carriage is adapted to move along a drilling mast, and includes a body structure, electric motors coupled to the body structure, and pinions operably coupled to the electric motors, respectively. The pinions are adapted to engage racks, respectively. According to another aspect, a drilling mast includes a longitudinally-extending frame having a first side portion and a second side portion spaced therefrom. Racks are coupled to the frame at the first side portion thereof. According to yet another aspect, an apparatus includes a drilling mast or tower extending longitudinally along an axis, the tower including racks spaced in a parallel relation. A top drive is movable along the axis and relative to the tower. Electric motors are coupled to the top drive and movable therewith. Pinions are operably coupled to the electric motors, respectively, and engage the racks, respectively, to move the top drive.

18 Claims, 9 Drawing Sheets

(56) References Cited

U.S. PATENT DOCUMENTS

| | | | | |
|---|---|---|---|---|
| 4,203,576 | A | 5/1980 | Sutton | |
| 4,586,572 | A | 5/1986 | Myers et al. | |
| 4,718,805 | A | 1/1988 | Becker | |
| 4,843,945 | A | 7/1989 | Dinsdale | |
| 5,342,020 | A * | 8/1994 | Stone | B66D 1/485 254/269 |
| 5,423,390 | A | 6/1995 | Donnally et al. | |
| 7,134,513 | B1 | 11/2006 | Randall et al. | |
| 7,255,180 | B2 | 8/2007 | Beato et al. | |
| 7,318,491 | B2 | 1/2008 | Riel | |
| 7,347,285 | B2 | 3/2008 | Hamner | |
| 7,744,327 | B2 | 6/2010 | Lops et al. | |
| 7,802,636 | B2 | 9/2010 | Childers et al. | |
| 7,905,300 | B2 | 3/2011 | Rieder et al. | |
| 8,033,345 | B1 | 10/2011 | Randall et al. | |
| 8,046,959 | B2 | 11/2011 | Stoetzer et al. | |
| 8,052,370 | B2 | 11/2011 | Dekker et al. | |
| 8,157,495 | B1 | 4/2012 | Randall | |
| 8,671,626 | B1 * | 3/2014 | Marty et al. | 52/117 |
| 2001/0015274 | A1 | 8/2001 | Gipson | |
| 2005/0241857 | A1 | 11/2005 | Beato et al. | |
| 2005/0279507 | A1 | 12/2005 | Folk et al. | |
| 2008/0053704 | A1 | 3/2008 | Zachariasen et al. | |
| 2008/0251267 | A1 | 10/2008 | Cicognani | |
| 2009/0053015 | A1 | 2/2009 | Zachariasen et al. | |
| 2009/0084537 | A1 | 4/2009 | Rudshaug et al. | |
| 2009/0101410 | A1 * | 4/2009 | Egilsson et al. | 175/24 |
| 2009/0196712 | A1 | 8/2009 | Mortensen et al. | |
| 2009/0250205 | A1 * | 10/2009 | Koopmans | E21B 19/22 166/66.4 |
| 2009/0314547 | A1 | 12/2009 | Stoetzer et al. | |
| 2010/0193247 | A1 * | 8/2010 | Riddle et al. | 175/57 |
| 2010/0230166 | A1 | 9/2010 | Sigmar et al. | |
| 2010/0319999 | A1 | 12/2010 | Haughom | |
| 2010/0329823 | A1 | 12/2010 | Baumler et al. | |
| 2011/0148133 | A1 | 6/2011 | Hessels | |
| 2011/0188973 | A1 | 8/2011 | Baumler | |
| 2011/0214917 | A1 | 9/2011 | Boudreaux | |
| 2011/0240371 | A1 | 10/2011 | Murr et al. | |
| 2011/0247290 | A1 | 10/2011 | Beck et al. | |
| 2012/0097454 | A1 | 4/2012 | Kockeis et al. | |
| 2012/0103623 | A1 | 5/2012 | Wijning et al. | |
| 2013/0299189 | A1 | 11/2013 | Reddy et al. | |
| 2013/0299190 | A1 | 11/2013 | Reddy et al. | |
| 2013/0299244 | A1 | 11/2013 | Reddy et al. | |
| 2013/0327543 | A1 | 12/2013 | Reddy et al. | |

FOREIGN PATENT DOCUMENTS

| | | | | |
|---|---|---|---|---|
| WO | 2004018829 | A1 | 3/2004 | |
| WO | 205073497 | A1 | 8/2005 | |
| WO | 2005073471 | A1 | 8/2005 | |
| WO | 2005073495 | A1 | 8/2005 | |
| WO | WO 2005073495 | A1 * | 8/2005 | E21B 15/00 |
| WO | 2011016719 | A1 | 2/2011 | |
| WO | 2011120627 | A2 | 10/2011 | |
| WO | 2012032384 | A1 | 3/2012 | |

* cited by examiner

DRILLING RIG CARRIAGE MOVABLE ALONG RACKS AND INCLUDING PINIONS DRIVEN BY ELECTRIC MOTORS

CROSS-REFERENCE TO RELATED APPLICATION

This application is a continuation in part of co-pending U.S. application Ser. No. 13/797,265 filed Mar. 12, 2013, the entire disclosure of which is hereby incorporated herein by reference. U.S. application Ser. No. 13/797,265 claims the benefit of and priority to U.S. Provisional Application No. 61/646,686 filed May 14, 2012, entitled "Drilling Rig and Methods," to Reddy et al., the entire disclosure of which is hereby incorporated herein by reference.

BACKGROUND OF THE DISCLOSURE

The present disclosure relates in general to drilling rigs, and in particular to a drilling rig employing a carriage movable along racks and including pistons driven by electric motors. In several exemplary embodiments, a top drive is coupled to the carriage.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
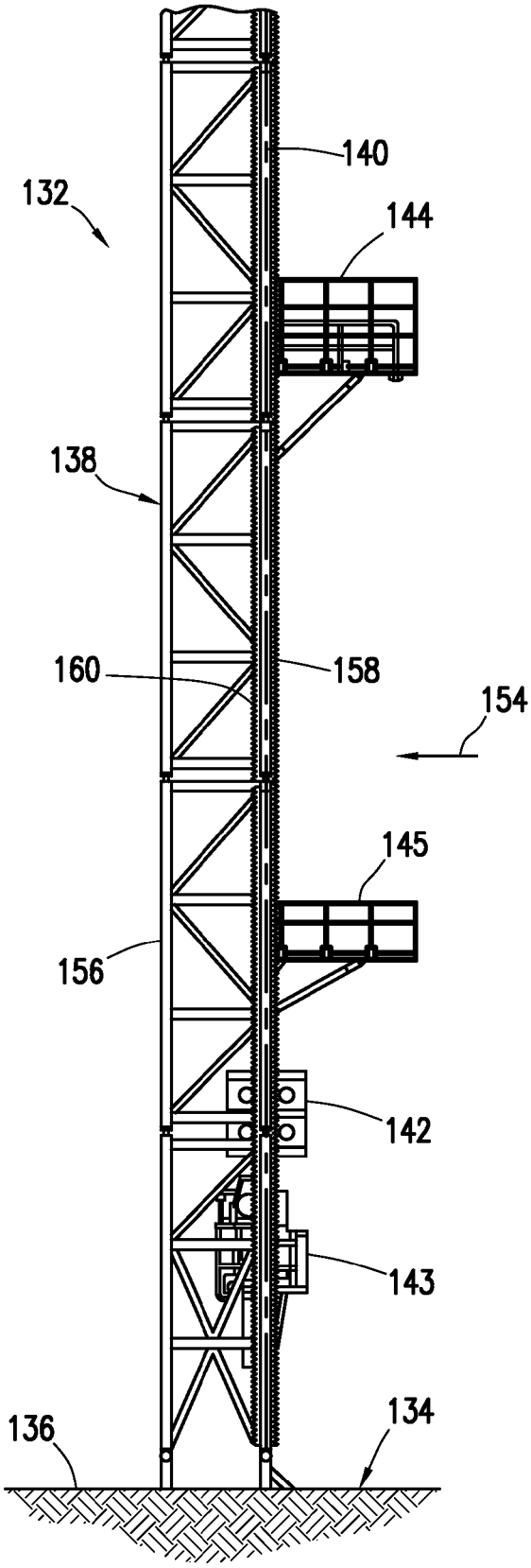
FIG. 1 is a right side elevational view of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring to FIG. 1, illustrated is a right side elevational view of an apparatus 132. The apparatus 132 may be, include, or be part of, a land-based drilling rig. In several exemplary embodiments, instead of a land-based drilling rig, the apparatus 132 may be, include, or be part of, any type of drilling rig, such as a jack-up rig, a semi-submersible rig, a drill ship, a coil tubing rig, a platform rig, a slant rig, or a casing drilling rig, among others. The apparatus 132 includes a platform 134, which includes a rig floor 136 that is positioned adjacent or above the wellbore 16 (not shown in FIG. 1). In several exemplary embodiments, the platform 134 may be, include, or be a part of, one or more of several types of platforms.

In some embodiments, the platform 134 may be part of a land-based drilling rig which is capable of skidding or walking through a drilling pad using, for example, skids or walking pods (not shown). The land-based drilling rig may skid or walk in two directions, generally known as a two-axis rig. The drill floor of the drilling rig may be oriented so that the V-door is perpendicular to any substructure boxes, which may allow the rig to skid or walk over existing well heads. Such a drilling rig may include one or all shaker tanks directly pinned to the substructure of the rig to allow continuous connection thereto.

A tower or drilling mast 138 is coupled to the platform 134, and extends longitudinally along an axis 140. In one embodiment, the drilling mast 138 is releasably coupled. In several exemplary embodiments, the drilling mast 138 may be characterized as a conventional drilling mast.

A drilling carriage 142 is movably coupled to the drilling mast 138. A top drive 143 is coupled to the drilling carriage 142. The top drive 143 extends longitudinally in a parallel relation to the drilling mast 138. As will be described in further detail below, the drilling carriage 142 and the top drive 143 coupled thereto are movable along the axis 140, relative to the drilling mast 138. In several exemplary embodiments, the apparatus 132 does not include the top drive 143; instead, the apparatus 132 may be, include, or be a part of, another type of drilling rig such as, for example, a rotary-swivel rig or a power-swivel rig. A platform, or racking board 144, is coupled to the drilling mast 138 at a vertical position above the rig floor 136. A platform, or belly board 145, is coupled to the drilling mast 138 at a vertical position between the rig floor 136 and the racking board 144.

Referring to FIGS. 2-5 illustrated are respective perspective, front elevational, left side elevational, and top plan views of the drilling carriage 142. A body structure 146 includes side portions 146*a* and 146*b*, which are spaced in a parallel relation. The side portion 146*b* is spaced from the side portion 146*a* in a direction 147 that is perpendicular to the longitudinal extension of the drilling mast 138. A lower portion 146*c* forms an attachment point to couple to the top drive 143 (not shown in FIG. 5). Electric motors 148*a*, 148*b*, 148*c*, and 148*d* are coupled to the side portion 146*a*. Similarly, electric motors 150*a*, 150*b*, 150*c*, and 150*d* are coupled to the side portion 146*b*. The electric motors are vertically aligned along the longitudinal extension of the drilling mast 138 (or the axis 140). The electric motors 148*c*, 148*d*, 150*c*, and 150*d* are vertically aligned along the longitudinal extension of the drilling mast 138. Each set of the electric motors 148*a*, 148*b*, 150*a*, and 150*b*, and 148*c*, 148*d*, 150*c*, and, is vertically spaced from the other set along the longitudinal extension of the drilling mast 138 (or the axis 140).

In an exemplary embodiment, each of the electric motors 148*a*-148*d* and 150*a*-150*d* is a permanent magnet AC motor and is controlled by either a single variable-frequency drive (VFD) or multiple VFDs, which is/are synchronized and programmed to work simultaneously with the other motors to provide uniform motion and torque. In an exemplary embodiment, one or more of the electric motors 148*a*-148*d* and 150*a*-150*d* are controlled by a single VFD. In an exemplary embodiment, one or more the electric motors 148*a*-148*d* and 150*a*-150*d* are controlled by multiple VFDs. In an exemplary embodiment, each of the electric motors 148*a*-148*d* and 150*a*-150*d* is a permanent magnet AC motor and provides primary dynamic braking.

Pinions 152*a* and 152*b* are operably coupled to the electric motors 148*a* and 148*b*, respectively. The pinion 152*b* is spaced from the pinion 152*a* in a direction 153, which is perpendicular to each of the direction 147 and the longitudinal extension of the drilling mast 138. Pinions 152*c* and 152*d* are operably coupled to the electric motors 148*c* and 148*c*1, respectively. The pinion 152*d* is spaced from the pinion 152*c* in the direction 153. Similarly, pinions 154*a* and 154*b* are operably coupled to the electric motors 150*a* and 150*b*, respectively. The pinion 154*b* is spaced from the pinion 154*a* in the direction 153. Pinions 154*c* and 154*c*1 are operably coupled to the electric motors 150*c* and 150*d*, respectively. The pinion 154*d* is spaced from the pinion 154*c* in the direction 153. The pinions 154*a* and 154*b* are spaced from the pinions 152*a* and 152*b*, respectively, in the direction 147. Likewise, the pinions 154*c* and 154*d* are spaced from the pinions 152*c* and 152*d*, respectively, in the direction 147.

Figure 2:
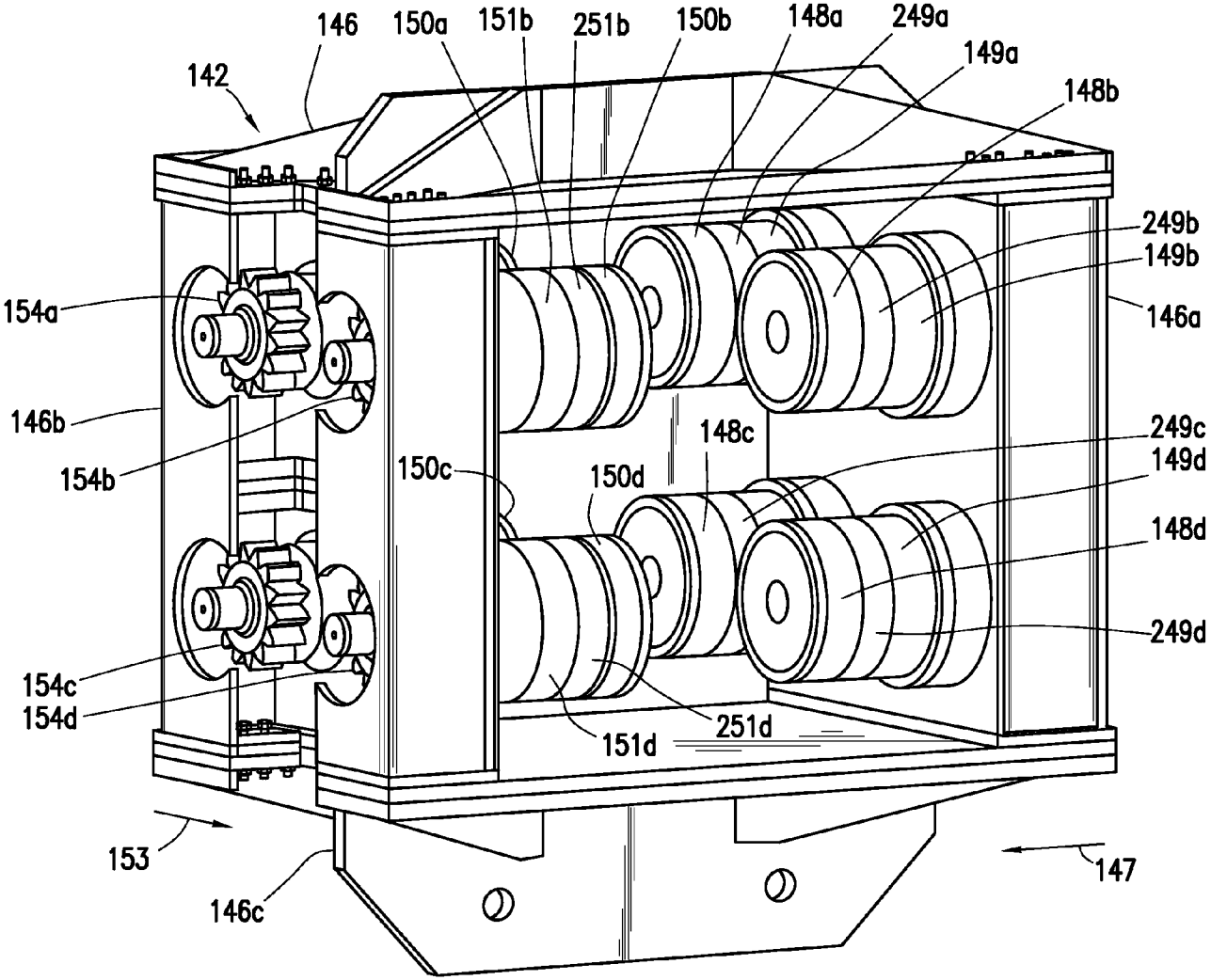
FIG. 2 is a perspective view of a drilling carriage of the apparatus of FIG. 1 according to one or more aspects of the present disclosure.
Figure 3A:
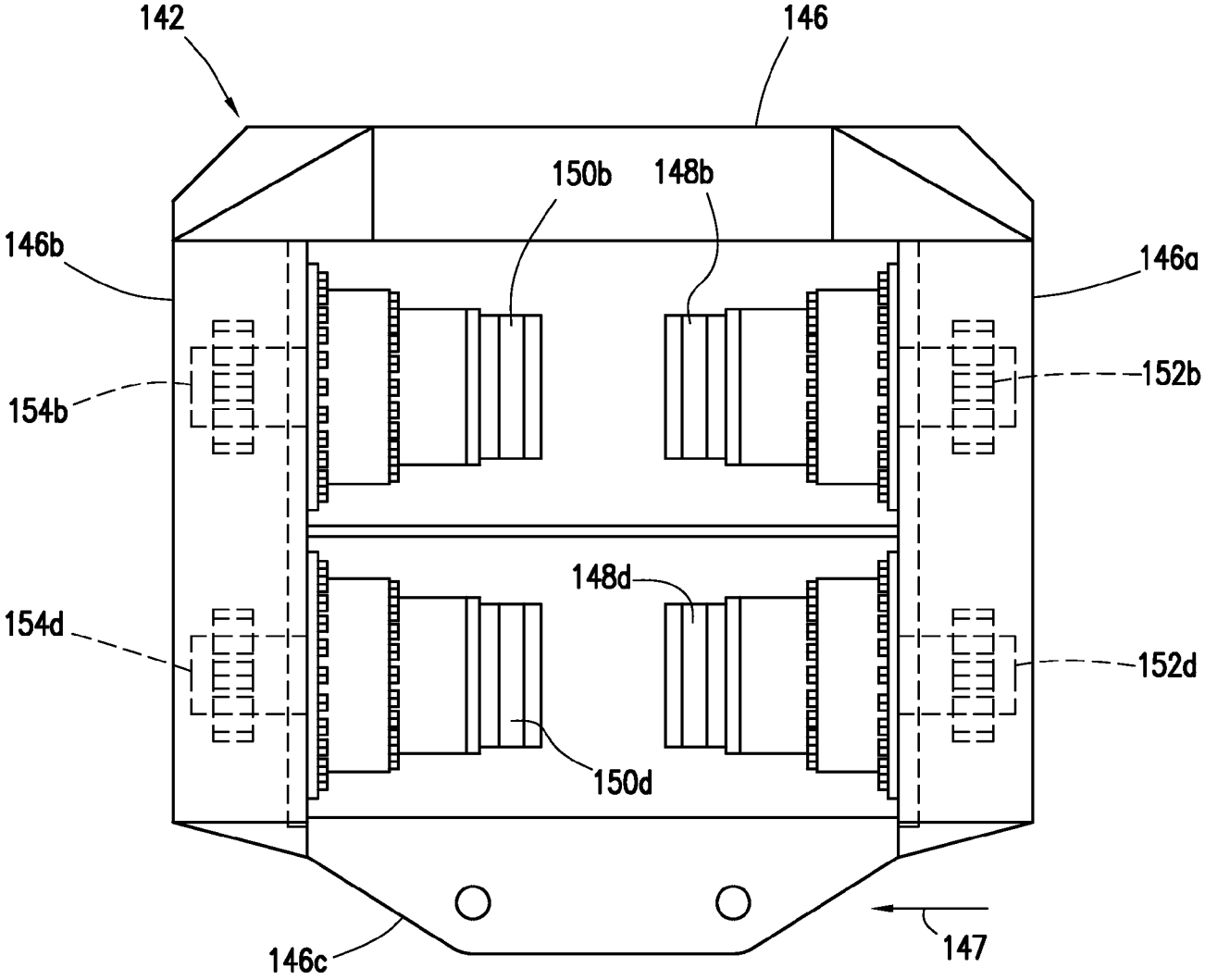
FIG. 3*a* is a front elevational view of the drilling carriage of FIG. 2 according to one or more aspects of the present disclosure.

In some embodiments, each of the electric motors 148*a*-148*d* and 150*a*-150*d* is coupled to pinions 152*a*-152*d* and 154*a*-154*d* through a gearbox 149*a*-149*d*, 151*a*-151*d* (FIGS. 2, 3*a*). In at least one embodiment, as depicted in FIG. 3*b*, electric motors 148*a*'-148*d*' and 150*a*'-150' directly drive pinions 152*a*-152*d* and 154*a*-154*d*, and are thus connected thereto directly.

Figure 3B:
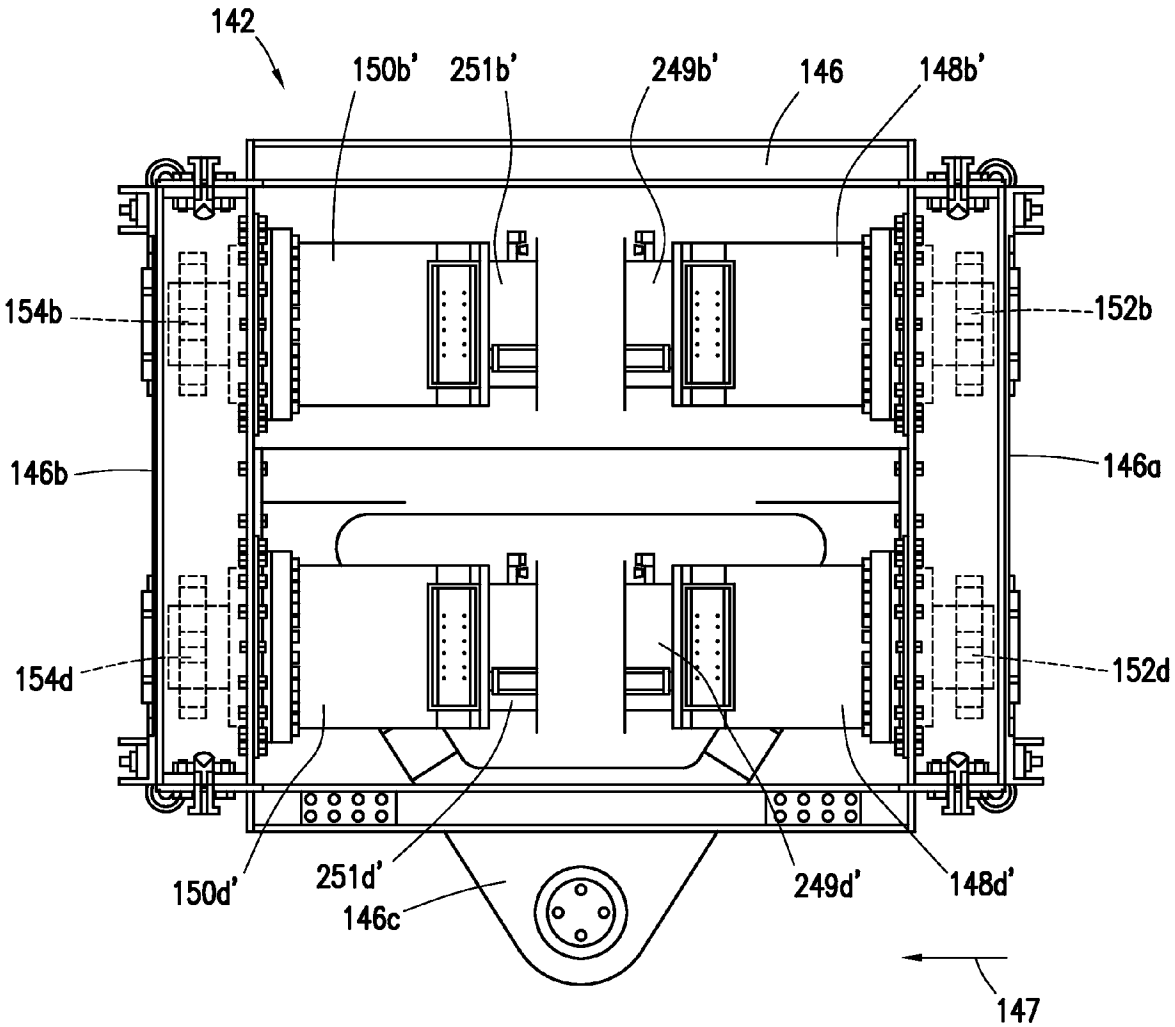
FIG. 3*b* is a front elevational view of a drilling carriage according to one or more aspects of the present disclosure.
Figure 4:
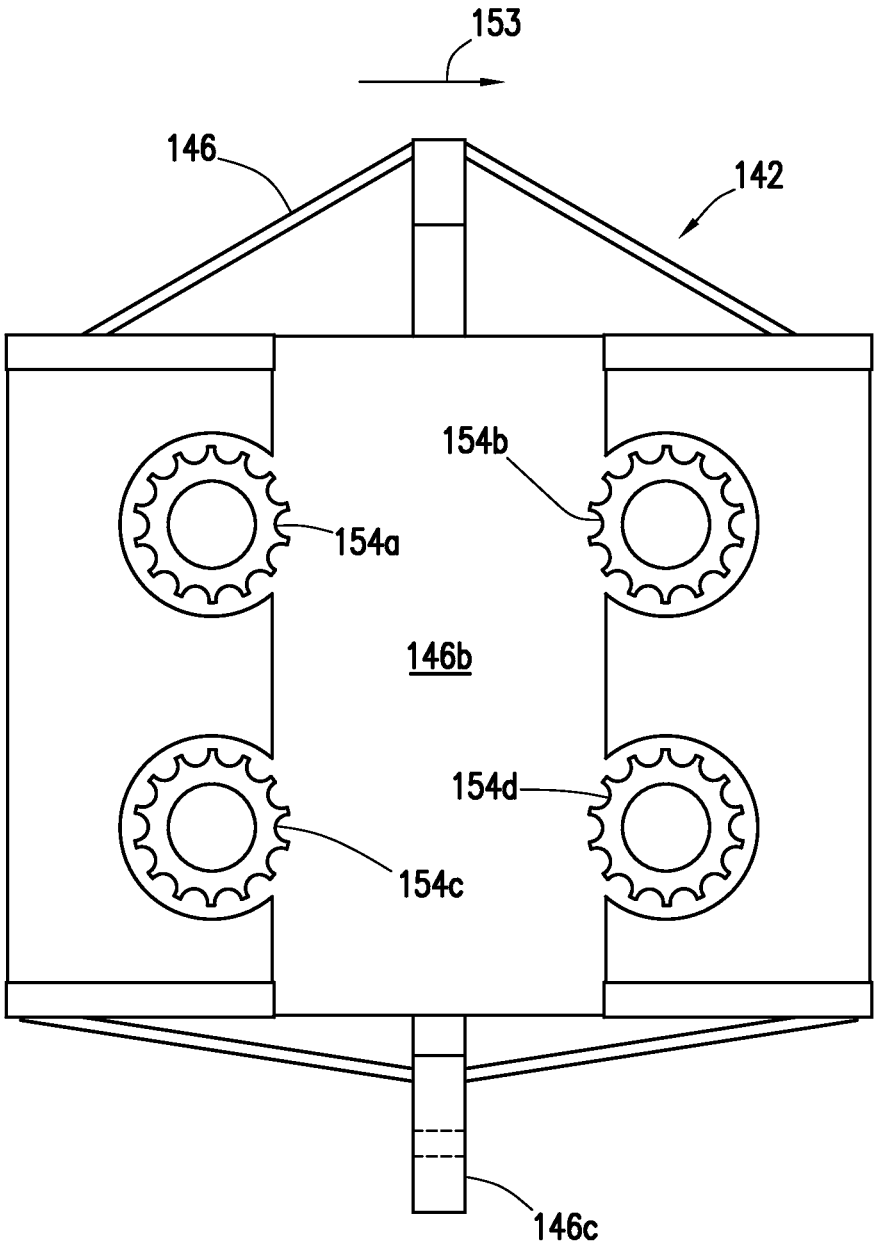
FIGS. 4-5 are left side elevational and top plan views, respectively, of the drilling carriage of FIG. 2 according to one or more aspects of the present disclosure.
Figure 5:
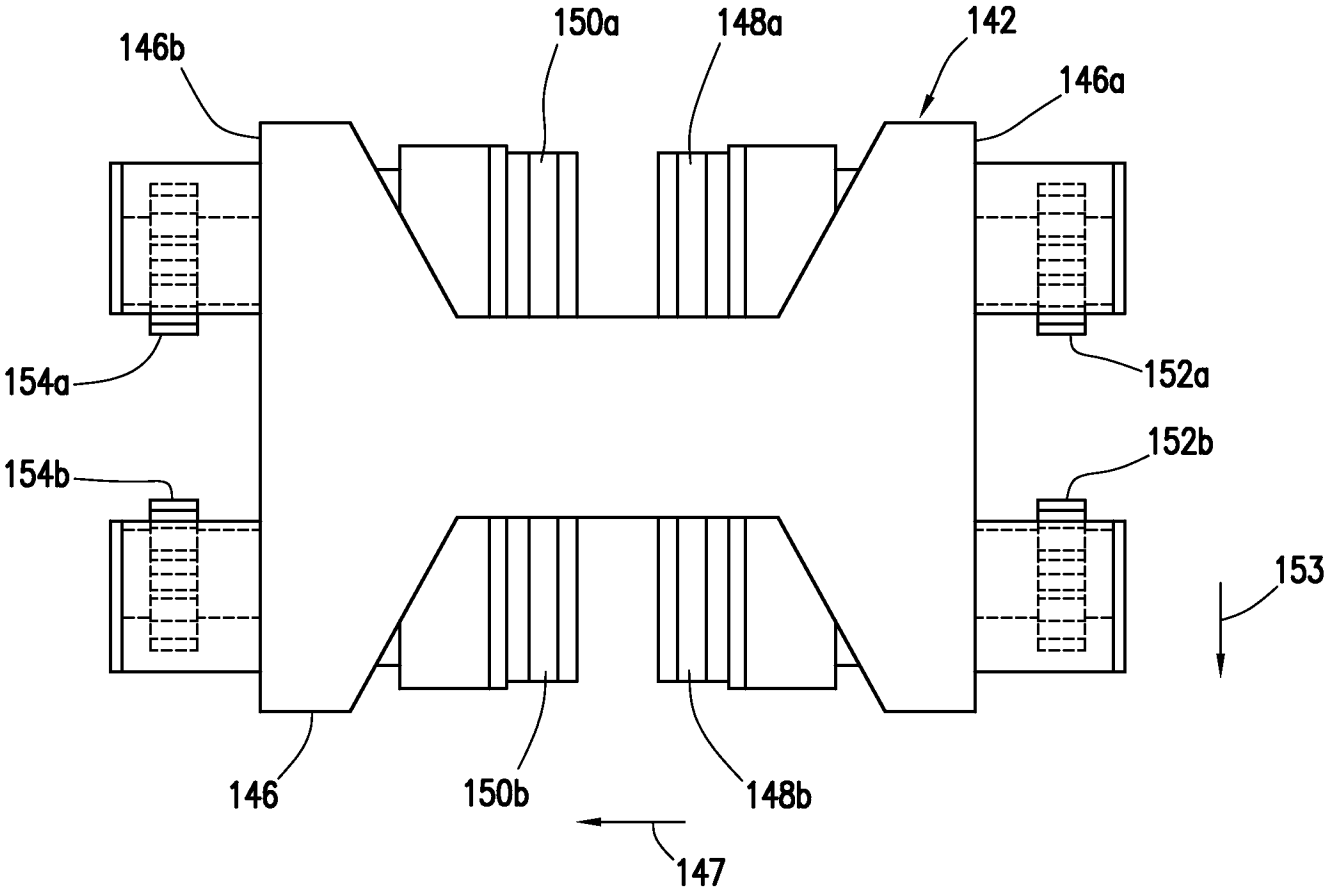

In some embodiments, each of the electric motors 148*a*-148*d* and 150*a*-150*d* includes a brake 249*a*-249*d*, 251*a*-251*d* (FIGS. 2, 3*a*; 249*b*', 249*d*', 251*b*', and 251*d*' in FIG. 3*b*). Each brake 249*a*-249*d*, 251*a*-251*d* may be, for example, a mechanical hydraulic brake located between the respective electric motor 148*a*-148*d* and 150*a*-150*d* and a gearbox. In some embodiments, brakes 249*a*-249*d*, 251*a*-251*d* may act as a failsafe measure to hold drilling carriage 142 in place. In some embodiments, brakes 249*a*-249*d*, 251*a*-251*d* may have a normally engaged design, for example by being spring actuated and opened by a hydraulic system or by air pressure. In an exemplary embodiment, each of the electric motors 148*a*-148*d* and 150*a*-150*d* may be used to provide regenerative braking, by capturing current induced in the coils of the electric motors 148*a*-148*d* and 150*a*-150*d* to generate electricity from upward motion, for example, in response to gravitic forces on a supported drill string. In an exemplary embodiment, each of the electric motors 148*a*-148*d* and 150*a*-150*d* includes an encoder incorporated on the motor shaft to provide more precise VFD control.

Figure 6:
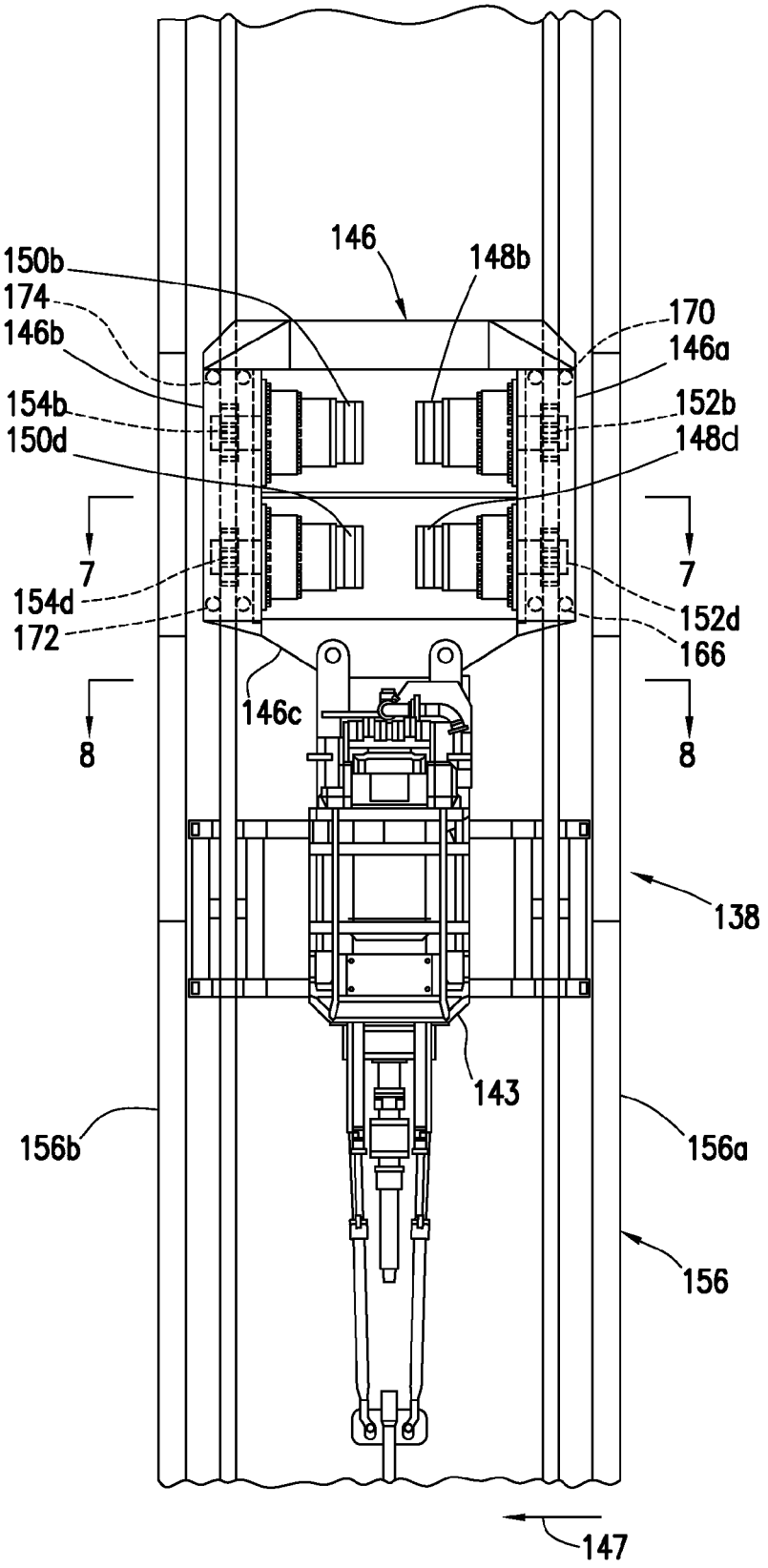
FIG. 6 is a front elevational view of a portion of the apparatus of FIG. 1 according to one or more aspects of the present disclosure.
Figure 7:
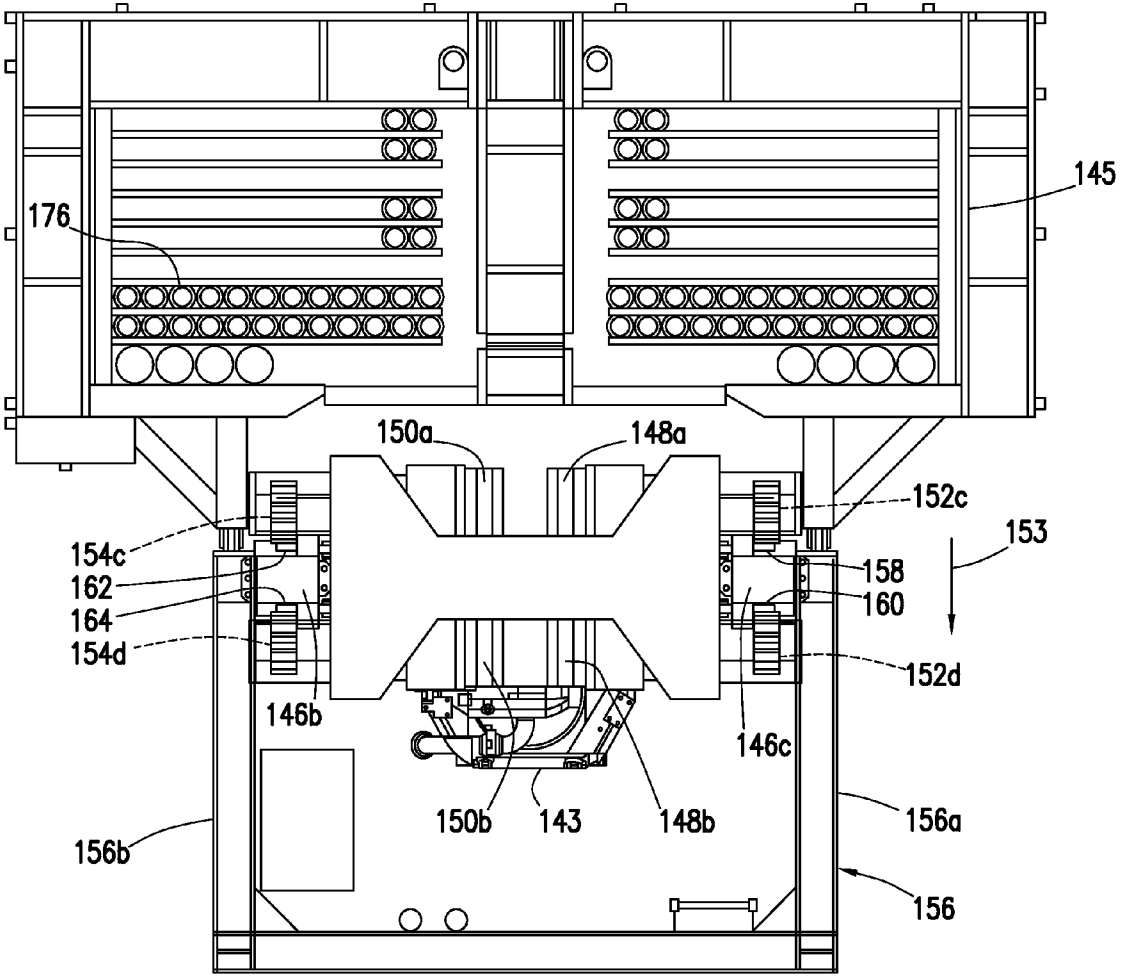
FIG. 7 is a sectional view taken along line 7-7 of FIG. 6 according to one or more aspects of the present disclosure.
Figure 8:
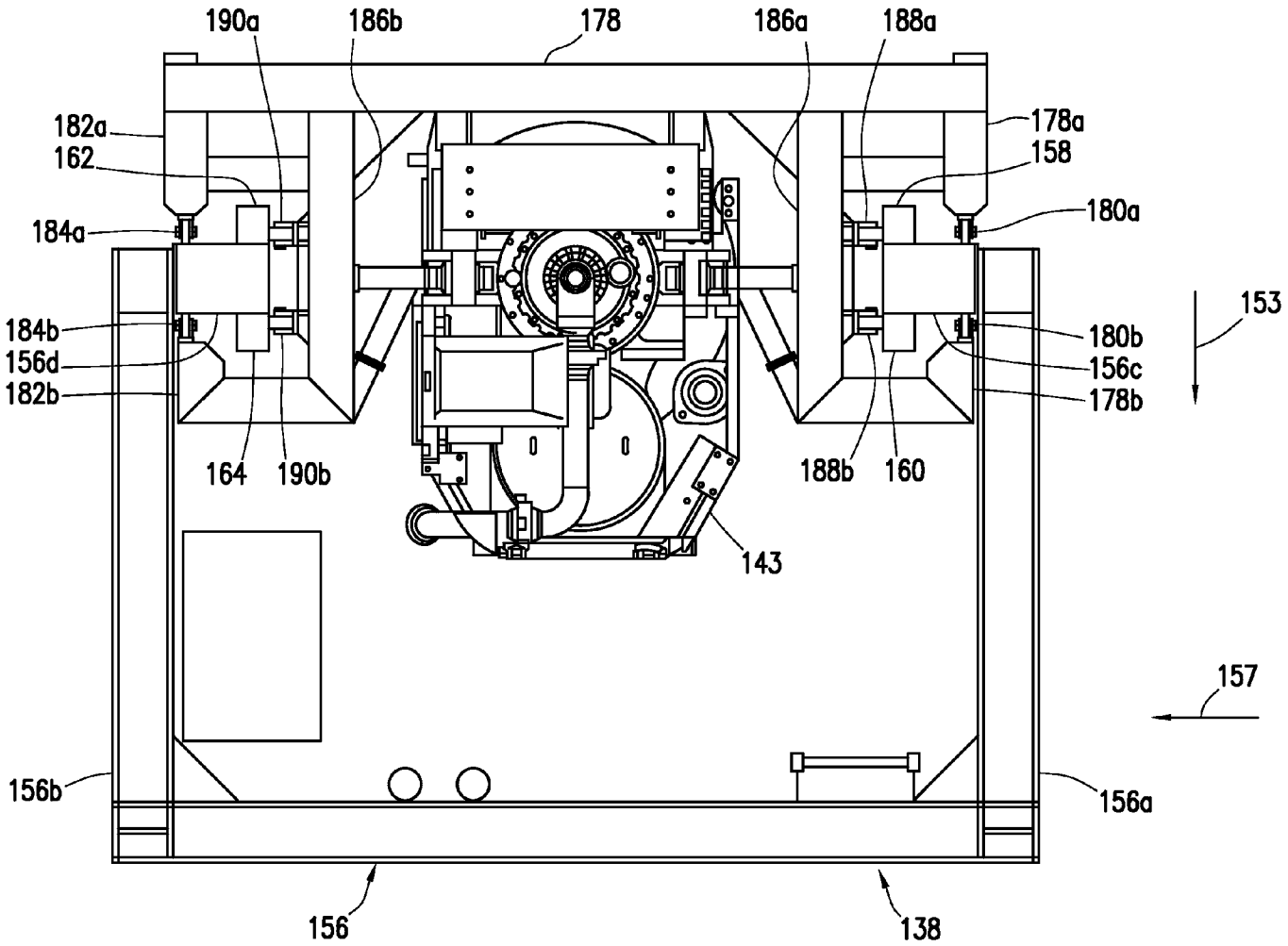
FIG. 8 is a sectional view taken along line 8-8 of FIG. 6 according to one or more aspects of the present disclosure.

Referring to FIGS. 6, 7, and 8, illustrated are a front elevational view, a sectional view taken along line 7-7 of FIG. 6, and a sectional view taken along line 8-8 of FIG. 6, respectively, of the apparatus 132. The drilling mast 138 includes a frame 156, which includes side portions 156*a* and 156*b*, which are spaced in a parallel relation. The side portion 156*b* is spaced from the side portion 156*a* in the direction 147.

Racks 158 and 160 are coupled to the frame 156 at the side portion 156*a* thereof. In an exemplary embodiment, the racks 158 and 160 are coupled to the frame 156 by being integrally formed with the frame 156. The rack 160 is spaced from the rack 158 in the direction 153. The rack 160 faces away from the rack 158. The pinion 152*b* is spaced from the pinion 152*a* in the direction 153 so that the pinions 152*a* and 152*b* engage the racks 158 and 160, respectively. Likewise, the pinion 152*d* is spaced from the pinion 152*c* in the direction 153 so that the pinions 152*c* and 152*d* engage the racks 158 and 160, respectively.

Similarly, racks 162 and 164 are coupled to the frame 156 at the side portion 156*b* thereof. In an exemplary embodiment, the racks 162 and 164 are coupled to the frame 156 by being integrally formed with the frame 156. The rack 164 is spaced from the rack 162 in the direction 153. The rack 164 faces away from the rack 162. The racks 162 and 164 are aligned with the racks 158 and 160, respectively, in the direction 153. The pinion 154*b* is spaced from the pinion 154*a* in the direction 153 so that the pinions 154*a* and 154*b* engage the racks 162 and 164, respectively. Likewise, the pinion 154*d* is spaced from the pinion 154*c* in the direction 153 so that the pinions 154*c* and 154*d* engage the racks 162 and 164, respectively.

A plurality of rollers 166, including rollers 166*a*, 166*b*, 166*c*, and 166*d*, may be coupled to the side portion 146*a* of the body structure 146 at a location proximate the lower portion 146*c*. The rollers engage the respective outer and inner sides of the racks 158 and 160, respectively. Under conditions to be described below, the plurality of rollers 166 facilitate in guiding the carriage 142 as it moves up and down the drilling mast 138, and facilitate in maintaining the respective engagements between the pinions 152*a* and 152*c* and the rack 158, and the respective engagements between the pinions 152*b* and 152*d* and the rack 160.

As shown in FIG. 6, a plurality of rollers 170 is coupled to the side portion 146*a* at a location proximate a top portion 146*d* of the body structure 146. Pluralities of rollers 172 and 174 are coupled to the side portion 146*b* at respective locations proximate the lower portion 146*c* and the top portion 146*d*. Each of the pluralities of rollers 170, 172, and 174 is substantially identical to the plurality of rollers 166 and therefore the rollers 170, 172 and 174 will not be described in further detail.

As shown in FIG. 7, the apparatus 132 is capable of racking pipe, and thus supports tubular members (or tubulars) 176, such as drill pipe or casing as part of oil and gas exploration and production operations. In several exemplary embodiments, the belly board 145 and/or the racking board 144 may be used to support the tubular members 176. In several exemplary embodiments, the tubular members 176 may be Range II triple tubulars and thus may be about 93 feet long. In several exemplary embodiments, the tubular members 176 may be Range III double tubulars and thus may be about 92 feet long. In several exemplary embodiments, the tubular members 176 may be Range II tubulars and thus may be about 31 feet long. In several exemplary embodiments, the tubular members 176 may be Range III tubulars and thus may be about 46 feet long.

As shown in FIG. 8, the top drive 143 is coupled to a body structure 178, which is movable with the top drive 143 and the drilling carriage 142. The body structure 178 includes arms 178*a* and 178*b*, to which rollers 180*a* and 180*b* are coupled, respectively. The rollers 180*a* and 180*b* respectively engage opposing sides of a vertically-extending member 156*c* of the frame 156 of the drilling mast 138. The body structure 178 further includes arms 182*a* and 182*b*, to which rollers 184*a* and 184*b* are coupled, respectively. The rollers 184*a* and 184*b* respectively engage opposing sides of a vertically-extending member 156*d* of the frame 156 of the drilling mast 138. An arm 186*a* is coupled between the top drive 143 and the arms 178*a* and 178*b*, and an arm 186*b* is coupled between the top drive 143 and the arms 182*a* and 182*b*. Rollers 188*a* and 188*b* are coupled to the arm 186*a*, and engage the respective inner sides of the racks 158 and 160. Rollers 190*a* and 190*b* are coupled to the arm 186*b*, and engage the respective inner sides of the racks 162 and 164. Under conditions to be described below, the rollers 180*a*, 180*b*, 184*a*, 184*b*, 188*a*, 188*b*, 190*a* and 190*b* facilitate in guiding the top drive 143 as it moves up and down the drilling mast 138, and facilitate in maintaining the respective engagements between the pinions 152*a* and 152*c* and the rack 158, the respective engagements between the pinions 152*b* and 152*d* and the rack 160, the respective engagements between the pinions 154*a* and 154*c* and the rack 162, and the respective engagements between the pinions 154*b* and 154*d* and the rack 164.

In operation, in an exemplary embodiment with continuing reference to FIGS. 1-8, the apparatus 132 is employed to assemble a string of the tubular members 176. More particularly, at least one of the tubular members 176 is temporarily coupled to the top drive 143, which operates to couple (or separate) that tubular member 176 to (or from) another of the tubular members 176 which already extends within the wellbore 16 or is vertically positioned between the wellbore 16 and the tubular member 176 coupled to the top drive 143. For all embodiments described herein, the operations disclosed herein may be conducted in reverse to trip pipe or casing out of a wellbore and disassemble tubular members or pairs of tubular members from the string of tubular members. As noted above, in several exemplary embodiments, the tubular members 176 may be Range II tubulars, and/or the tubular members 176 may be Range III tubulars.

The electric motors 148*a* and 148*c* cause the respective pinions 152*a* and 152*c* to rotate and engage teeth of the rack 158. The electric motors 148*b* and 148*d* cause the respective pinions 152*b* and 152*d* to rotate and engage teeth of the rack 160. The electric motors 150*a* and 150*c* cause the respective pinions 154*a* and 154*c* to rotate and engage teeth of the rack 162. The electric motors 150*b* and 150*d* cause the respective pinions 154*b* and 154*d* to rotate and engage teeth of the rack 164. As a result, the drilling carriage 142 and thus the top drive 143 move upward and/or downward, along the axis 140 and relative to the drilling mast 138 as necessary, so that the top drive 143 is at a position along the axis 140 at which one of the tubular members 176 can be coupled to the top drive 143.

The electric motors 148*a*-148*d* and 150*a*-150*d* move the top drive 143 downward along the axis 140 and relative to the drilling mast 138, lowering the tubular member 176 coupled to the top drive 143. Before, during or after this lowering, the top drive 143 operates to couple the tubular member 176 coupled to the top drive 143 to another of the tubular members 176 either extending in the wellbore 16 or being vertically positioned between the wellbore 16 and the tubular member 176 coupled to the top drive 143; this other tubular member 176 may be part of a string of drill pipe or casing.

In several exemplary embodiments, during the upward and/or downward movement of the top drive 143, the plurality of rollers 166 facilitate in guiding the carriage 142 as it moves up and down the drilling mast 138, and facilitate in maintaining the respective engagements between the pinions 152*a* and 152*c* and the rack 158, and the respective engagements between the pinions 152*b* and 152*d* and the rack 160. Similarly, in several exemplary embodiments, the rollers 180*a*, 180*b*, 184*a*, 184*b*, 188*a*, 188*b*, 190*a* and 190*b* facilitate in guiding the top drive 143 as it moves up and down the drilling mast 138, and facilitate in maintaining the respective engagements between the pinions 152*a* and 152*c* and the rack 158, the respective engagements between the pinions 152*b* and 152*d* and the rack 160, the respective engagements between the pinions 154*a* and 154*c* and the rack 162, and the respective engagements between the pinions 154*b* and 154*d* and the rack 164.

In several exemplary embodiments, the arrangement of the rack 158 and the rack 160 facing away from the rack 158 at the side portion 156*a* of the frame 156 reduces the degree to which the racks 158 and 160 undergo bending and/or torsional loading, thereby reducing the risk of unacceptable stress and strain levels in the frame 156 and the racks 158 and 160. Likewise, in several exemplary embodiments, the arrangement of the rack 162 and the rack 164 facing away from the rack 162 at the side portion 156*b* of the frame 156 reduces the degree to which the racks 162 and 164 undergo bending and/or torsional loading, thereby reducing the risk of unacceptable stress and strain levels in the frame 156 and the racks 162 and 164.

In several exemplary embodiments, the apparatus 132 is not limited to tubular singles using a box (or frame) style structure for a drilling mast. Instead, in several exemplary embodiments, the apparatus 132 can be used with a conventional style drilling mast capable of handling tubular Range II triples, tubular Range II Quads, or tubular Range III doubles and capable of racking pipe. In several exemplary embodiments, the apparatus 132 is capable of racking pipe in the drilling mast 138, increasing drilling speed, and providing off-line stand building, among other capabilities.

In several exemplary embodiments, the apparatus 132 or components thereof may be used in a wide variety of drilling applications including, but not limited to, horizontal drilling applications, thermal drilling applications, etc.

In view of the above and the figures, one of ordinary skill in the art will readily recognize that the present disclosure introduces an apparatus that includes a drilling mast, which includes a longitudinally-extending frame having a first side portion and a second side portion spaced therefrom in a parallel relation and in a first direction that is perpendicular to the longitudinal extension of the frame; a first rack coupled to the frame at the first side portion thereof; and a second rack coupled to the frame at the first side portion thereof; wherein the second rack is spaced from the first rack in a parallel relation and in a second direction that is perpendicular to each of the first direction and the longitudinal extension of the frame; and wherein the second rack faces away from the first rack; and a drilling carriage adapted to move along the drilling mast, the drilling carriage including a body structure; first and second electric motors coupled to the body structure; and first and second pinions operably coupled to the first and the second electric motors, respectively; wherein the second pinion is spaced from the first pinion in the second direction so that the first and second pinions are adapted to engage the first and second racks, respectively. According to one aspect, the drilling mast further includes a third rack coupled to the frame at the second side portion thereof; and a fourth rack coupled to the frame at the second side portion thereof; wherein the fourth rack is spaced from the third rack in a parallel relation and in the second direction; and wherein the fourth rack faces away from the third rack; and wherein the drilling carriage further includes third and fourth electric motors coupled to the body structure; and third and fourth pinions operably coupled to the third and fourth electric motors, respectively; wherein the third and fourth pinions are spaced from the first and second pinions, respectively, in the first direction; and wherein the fourth pinion is spaced from the third pinion in the second direction so that the third and fourth pinions are adapted to engage the third and fourth racks, respectively.

According to another aspect, the first and second racks are aligned with the third and fourth racks, respectively, in the second direction; wherein the first and second electric motors are aligned along the longitudinal extension of the drilling mast; wherein the third and fourth electric motors are aligned along the longitudinal extension of the drilling mast; and wherein the third and fourth electric motors are spaced from the first and second electric motors along the longitudinal extension of the drilling mast.

The present disclosure also introduces a drilling carriage adapted to move along a longitudinally-extending drilling mast, the drilling mast including a first rack and a second rack spaced therefrom in a parallel relation and in a first direction that is perpendicular to the longitudinal extension of the drilling mast, the second rack facing away from the first rack, the drilling carriage including a body structure; first and second electric motors coupled to the body structure; and first and second pinions operably coupled to the first and the second electric motors, respectively; wherein the second pinion is spaced from the first pinion in the first direction so that the first and second pinions are adapted to engage the first and second racks, respectively. According to one aspect, the drilling carriage includes third and fourth electric motors coupled to the body structure; and third and fourth pinions operably coupled to the third and fourth electric motors, respectively; wherein the third and fourth pinions are spaced from the first and second pinions, respectively, in a second direction that is perpendicular to each of the longitudinal extension of the drilling mast and the first direction; and wherein the fourth pinion is spaced from the third pinion in the first direction so that the third pinion is adapted to engage a third rack of the drilling mast and the fourth pinion is adapted to engage a fourth rack of the drilling mast that faces away from the third rack. According to another aspect, the first and second electric motors are aligned along the longitudinal extension of the drilling mast; wherein the third and fourth electric motors are aligned along the longitudinal extension of the drilling mast; and wherein the third and fourth electric motors are spaced from the first and second electric motors along the longitudinal extension of the drilling mast. According to yet another aspect, the second electric motor is spaced from the first electric motor along the longitudinal extension of the drilling mast. According to still yet another aspect, the fourth electric motor is spaced from the third electric motor along the longitudinal extension of the drilling mast.

The present disclosure also introduces a drilling mast along which a drilling carriage is adapted to move, the drilling mast including a longitudinally-extending frame having a first side portion and a second side portion spaced therefrom in a parallel relation and in a first direction that is perpendicular to the longitudinal extension of the frame; a first rack coupled to the frame at the first side portion thereof; and a second rack coupled to the frame at the first side portion thereof; wherein the second rack is spaced from the first rack in a parallel relation and in a second direction that is perpendicular to each of the first direction and the longitudinal extension of the frame; and wherein the second rack faces away from the first rack. According to one aspect, the drilling mast includes a third rack coupled to the frame at the second side portion thereof; and a fourth rack coupled to the frame at the second side portion thereof; wherein the fourth rack is spaced from the third rack in a parallel relation and in the second direction; and wherein the fourth rack faces away from the third rack. According to another aspect, the first and second racks are aligned with the third and fourth racks, respectively, in the second direction.

The present disclosure also introduces an apparatus including a tower extending longitudinally along a first axis, the tower including first and second racks spaced in a parallel relation and facing away from each other; a top drive to assemble or disassemble a string of tubular members, the top drive being movable along the first axis and relative to the tower; first and second electric motors coupled to the top drive and movable therewith; and first and second pinions operably coupled to the first and second electric motors, respectively, and engaged with the first and second racks, respectively, to move the top drive along the first axis and relative to the tower. According to one aspect, the apparatus includes a carriage to which each of the top drive and the first and second electric motors is coupled. According to another aspect, the first and second electric motors are spaced from each other in a direction that is perpendicular to the first axis; and wherein the first and second pinions are spaced from each other in the direction. According to yet another aspect, the first and second electric motors are spaced from each other in a first direction that is parallel to the first axis; wherein the first and second pinions are spaced from each other in the first direction and in a second direction that is perpendicular to the first axis; and wherein the apparatus further includes third and fourth pinions engaged with the first and second racks, respectively, wherein the third and fourth pinions are spaced from each other in each of the first and second directions. According to still yet another aspect, the apparatus includes a carriage coupled to the tower; a linking member pivotally coupled to the carriage to permit the linking member to pivot between first and second pivot positions about a second axis that is perpendicular to the first axis; and wherein the top drive extends longitudinally in a parallel relation to the tower; and wherein the top drive is pivotally coupled to the linking member to permit the top drive to continue to extend longitudinally in a parallel relation to the tower when the linking member pivots between the first and second pivot positions. According to still yet another aspect, the top drive is spaced from the tower by first and second spacings when the linking member is in the first and second pivot positions, respectively, the first and second spacings extending in a direction that is perpendicular to the first axis; and wherein the second spacing is greater than the first spacing. According to still yet another aspect, the apparatus includes at least one actuator extending between the carriage and the linking member to pivot the linking member between the first and second pivot positions. According to still yet another aspect, the apparatus includes a base to which the tower is pivotally coupled to pivot the tower between first and second pivot positions, the tower including a first portion; and a second portion pivotally coupled to the first portion to pivot the second portion between third and fourth pivot positions when the tower is in the first pivot position; and wherein the top drive is movable along each of the first and second portions of the tower when the second portion is in the fourth pivot position.

The present disclosure also introduces a method including providing a tower extending longitudinally along a first axis, the tower including first and second racks spaced in a parallel relation and facing away from each other; providing a top drive to assemble or disassemble a string of tubular members, the top drive being movable along the first axis and relative to the tower; coupling first and second electric motors to the top drive; operably coupling first and second pinions to the first and second electric motors, respectively; and engaging the first and second pinions with the first and second racks, respectively, to move at least the top drive and the first and second electric motors along the first axis and relative to the tower. According to one aspect, the method includes coupling a carriage to the top drive and the first and second electric motors. According to another aspect, the first and second electric motors are spaced from each other in a direction that is perpendicular to the first axis; and wherein the first and second pinions are spaced from each other in the direction. According to yet another aspect, the first and second electric motors are spaced from each other in a first direction that is parallel to the first axis; wherein the first and second pinions are spaced from each other in the first direction and in a second direction that is perpendicular to the first axis; and wherein the method further includes engaging third and fourth pinions with the first and second racks, respectively, so that the third and fourth pinions are spaced from each other in each of the first and second directions. According to still yet another aspect, the method includes coupling a carriage to the tower; pivotally coupling a linking member to the carriage to permit the linking member to pivot between first and second pivot positions about a second axis that is perpendicular to the first axis; and pivotally coupling the top drive to the linking member so that the top drive extends longitudinally in a parallel relation to the tower, the top drive being pivotally coupled to the linking member to permit the top drive to continue to extend longitudinally in a parallel relation to the tower when the linking member pivots between the first and second pivot positions. According to still yet another aspect, the top drive is spaced from the tower by first and second spacings when the linking member is in the first and second pivot positions, respectively, the first and second spacings extending in a direction that is perpendicular to the first axis; and wherein the second spacing is greater than the first spacing. According to still yet another aspect, the method includes extending at least one actuator between the carriage and the linking member to pivot the linking member between the first and second pivot positions. According to still yet another aspect, the tower includes a first portion and a second portion pivotally coupled thereto; and wherein the method further includes pivoting the tower between first and second pivot positions; pivoting the second portion between third and fourth pivot positions when the tower is in the first pivot position; and moving the top drive along each of the first and second portions of the tower when the second portion is in the fourth pivot position.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions, and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112, paragraph 6 for any limitations of any of the claims herein, except for those in which the claim expressly uses the word "means" together with an associated function.

What is claimed is:

1. A drilling carriage adapted to move along a drilling mast extending in a longitudinal direction, the drilling carriage comprising:

a body structure having a first side and a second side, the first and second sides parallel to the longitudinal direction and parallel to each other, separated in a first direction perpendicular to the longitudinal direction;

a first permanent magnet electric motor coupled to the body structure, and a first pinion operatively coupled to the first permanent magnet electric motor positioned to mesh with a first rack coupled to the drilling mast and extending in the longitudinal direction;

a second permanent magnet electric motor coupled to the body structure, and a second pinion operatively coupled to the second permanent magnet electric motor positioned to mesh with a second rack coupled to the drilling mast and extending in the longitudinal direction;

a third permanent magnet electric motor coupled to the body structure, and a third pinion operatively coupled to the third permanent magnet electric motor positioned to mesh with a third rack coupled to the drilling mast and extending in the longitudinal direction;

a fourth permanent magnet electric motor coupled to the body structure, and a fourth pinion operatively coupled to the fourth permanent magnet electric motor positioned to mesh with a fourth rack coupled to the drilling mast and extending in the longitudinal direction;

the first, second, third, and fourth permanent magnet electric motors arranged such that the first, second, third, and fourth pinions are coplanar in a plane perpendicular to the longitudinal direction, the first and second permanent magnet electric motors are facing the opposite direction from the third and fourth permanent magnet electric motors, and the first and third permanent magnet electric motors and the second and fourth permanent magnet electric motors are collinear parallel to the first direction; and a second body structure, the second body structure including a top drive, the second body structure coupled to an attachment point formed at a lower surface of the first body structure, the second body structure including a first roller engaging a first side of the mast and a second roller engaging a second side of the mast, the second side opposing the first side.

2. The drilling carriage of claim 1, further comprising:

a plurality of rollers coupled to the body structure, a first roller of the plurality of rollers engaging an inner side of the first rack and a second roller of the plurality of rollers engaging an outer side of the first rack, the plurality of rollers positioned to rollingly contact the drilling mast to maintain the pinions in continuous contact with each pinion's respective rack.

3. The drilling carriage of claim 1, wherein the permanent magnet electric motors are each driven by a variable frequency drive.

4. The drilling carriage of claim 1, wherein the permanent magnet electric motors are configured to provide regenerative braking.

5. The drilling carriage of claim 1, wherein one or more of the permanent magnet electric motors includes a brake configured to arrest the motion of the drilling carriage.

6. The drilling carriage of claim 5, wherein the brake is pneumatically actuated.

7. The drilling carriage of claim 5, wherein the brake is hydraulically actuated.

8. The drilling carriage of claim 5, wherein the brake is normally closed, and actuates to release the motion of the drilling carriage.

9. An apparatus comprising:

a drilling mast extending in a longitudinal direction having:

a frame having a first side portion and a second side portion spaced therefrom in a parallel relation and in a first direction that is perpendicular to the longitudinal direction;

a first rack coupled to the frame at the first side portion thereof; and a second rack coupled to the frame at the first side portion thereof, the second rack spaced from the first rack in a parallel relation and in a second direction that is perpendicular to each of the first direction and the longitudinal extension of the frame the second rack facing away from the first rack; and a third rack coupled to the frame at the second side portion thereof; and a fourth rack coupled to the frame at the second side portion thereof, the fourth rack spaced from the third rack in a parallel relation and in the second direction; and the fourth rack facing away from the third rack, the first and second racks aligned with the third and fourth racks, respectively, in the second direction; and a drilling carriage adapted to move longitudinally along the drilling mast, the drilling carriage having:

a body structure having a first side and a second side, the first and second sides parallel to the longitudinal direction and parallel to each other, separated in a first direction perpendicular to the longitudinal direction;

a first permanent magnet electric motor coupled to the body structure, and a first pinion operatively coupled to the first permanent magnet electric motor positioned to mesh with the first rack;

a second permanent magnet electric motor coupled to the body structure, and a second pinion operatively coupled to the second permanent magnet electric motor positioned to mesh with the second rack;

a third permanent magnet electric motor coupled to the body structure, and a third pinion operatively coupled to the third permanent magnet electric motor positioned to mesh with the third rack;

a fourth permanent magnet electric motor coupled to the body structure, and a fourth pinion operatively coupled to the fourth permanent magnet electric motor positioned to mesh with the fourth rack;

the first, second, third, and fourth permanent magnet electric motors arranged such that the first, second, third, and fourth pinions are coplanar in a plane perpendicular to the longitudinal direction, the first and second permanent magnet electric motors are facing the opposite direction from the third and fourth permanent magnet electric motors, and the first and third permanent magnet electric motors and the second and fourth permanent magnet electric motors are collinear parallel to the first direction; and a second body structure, the second body structure including a top-drive, the second body structure coupled to a lower end of the first body structure of the drilling carriage, the top drive positioned to assemble or disassemble a string of tubular members and movable in the longitudinal direction by a longitudinal movement of the drilling carriage, the second body structure including a first roller engaging a first side of the mast and a second roller engaging a second side of the mast, the second side opposing the first side.

10. The apparatus of claim 9, wherein the drilling mast is separable into two or more longitudinal pieces.

11. The apparatus of claim 9, wherein the permanent magnet electric motors are configured to provide regenerative braking in response to an upward or downward movement of the drilling carriage.

12. The apparatus of claim 9, wherein the drilling mast further comprises at least one platform extending in a second direction, perpendicular to the longitudinal and first directions positioned to support tubular members in a vertical position.

13. The apparatus of claim 9, further comprising a base to which the drilling mast is pivotally coupled allow the drilling mast to pivot between a first and second pivot position.

14. A method, comprising:

providing a drilling mast extending in a longitudinal direction having:

a frame having a first side portion and a second side portion spaced therefrom in a parallel relation and in a first direction that is perpendicular to the longitudinal direction;

a first rack coupled to the frame at the first side portion thereof; and a second rack coupled to the frame at the first side portion thereof, the second rack spaced from the first rack in a parallel relation and in a second direction that is perpendicular to each of the first direction and the longitudinal extension of the frame the second rack facing away from the first rack; and a third rack coupled to the frame at the second side portion thereof; and a fourth rack coupled to the frame at the second side portion thereof, the fourth rack spaced from the third rack in a parallel relation and in the second direction; and the fourth rack facing away from the third rack, the first and second racks aligned with the third and fourth racks, respectively, in the second direction;

providing a drilling carriage having:

a body structure having a first side and a second side, the first and second sides parallel to the longitudinal direction and parallel to each other, separated in a first direction perpendicular to the longitudinal direction;

a first permanent magnet electric motor coupled to the body structure, and a first pinion operatively coupled to the first permanent magnet electric motor positioned to mesh with the first rack;

a second permanent magnet electric motor coupled to the body structure, and a second pinion operatively coupled to the second permanent magnet electric motor positioned to mesh with the second rack;

a third permanent magnet electric motor coupled to the body structure, and a third pinion operatively coupled to the third permanent magnet electric motor positioned to mesh with the third rack;

a fourth permanent magnet electric motor coupled to the body structure, and a fourth pinion operatively coupled to the fourth permanent magnet electric motor positioned to mesh with the fourth rack;

the first, second, third, and fourth permanent magnet electric motors arranged such that the first, second, third, and fourth pinions are coplanar in a plane perpendicular to the longitudinal direction, the first and second permanent magnet electric motors are facing the opposite direction from the third and fourth permanent magnet electric motors, and the first and third permanent magnet electric motors and the second and fourth permanent magnet electric motors are collinear parallel to the first direction;

coupling the drilling carriage to the drilling mast such that the first, second, third, and fourth pinion mesh with the first, second, third and fourth racks respectively;

coupling a second body structure to a lower end of the first body structure, the second body structure including a top drive, the second body structure including a first roller engaging a first side of the mast and a second roller engaging a second side of the mast, the second side opposing the first side;

coupling a tubular member to the top drive;

energizing the permanent magnet electric motors to move the drilling carriage in the longitudinal direction; and moving the tubular member and top drive in a longitudinal direction.

15. The method of claim 14, wherein:

one or more of the permanent magnet electric motors further comprises a brake configured to arrest the motion of the drilling carriage, and the method further comprises:

releasing the brake.

16. The method of claim 15, wherein the brake is pneumatically actuated.

17. The method of claim 15, wherein the brake is hydraulically actuated.

18. The method of claim 15, wherein the brake is normally closed, and actuates to release the motion of the drilling carriage.

* * * * *